US006767082B1

(12) United States Patent
Raisanen

(10) Patent No.: US 6,767,082 B1
(45) Date of Patent: Jul. 27, 2004

(54) SYSTEMS AND METHODS FOR VARYING FLUID PATH GEOMETRY FOR FLUID EJECTION SYSTEM

(75) Inventor: Alan D Raisanen, Sodus, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/456,750

(22) Filed: Jun. 9, 2003

(51) Int. Cl.[7] ..... B41J 2/05
(52) U.S. Cl. ..... 347/65
(58) Field of Search ..... 347/48, 65, 47

(56) References Cited

U.S. PATENT DOCUMENTS

| | | | | |
|---|---|---|---|---|
| 4,389,654 A | | 6/1983 | Bar-on et al. | |
| 5,790,156 A | | 8/1998 | Mutton et al. | |
| 5,897,789 A | | 4/1999 | Weber | |
| 5,900,892 A | | 5/1999 | Mantell et al. | |
| 6,309,050 B1 | * | 10/2001 | Ikeda et al. | 347/55 |
| 6,339,881 B1 | | 1/2002 | Fisher et al. | |
| 6,374,481 B1 | | 4/2002 | Wachtler et al. | |
| 6,412,926 B1 | | 7/2002 | Okuda | |
| 6,631,979 B2 | * | 10/2003 | Lebens et al. | 347/54 |

FOREIGN PATENT DOCUMENTS

| | | | |
|---|---|---|---|
| EP | 1057641 | * 12/2000 | |
| JP | 355100169 | * 7/1980 | 347/65 |

OTHER PUBLICATIONS

Hirata et al., "An ink–jet Head Using Diaphragm Microactuator", pp. 418–423.

* cited by examiner

*Primary Examiner*—Michael S. Brooke
(74) *Attorney, Agent, or Firm*—Oliff & Berridge, PLC

(57) ABSTRACT

A variable geometry fluid ejection system can be used to minimize a separation between a main drop and satellite drop on a recording medium in a bi-directional fluid ejection system. The geometry of the fluid ejection system is varied by placing an actuator in an ejector nozzle to selectively vary the geometry of the nozzle between opposing directions of motion of the fluid ejection system across a recording medium, thereby maintaining a constant distance of main drop satellite drop separation between the opposing directions of motion.

25 Claims, 8 Drawing Sheets

FIG. 1 (RELATED ART)
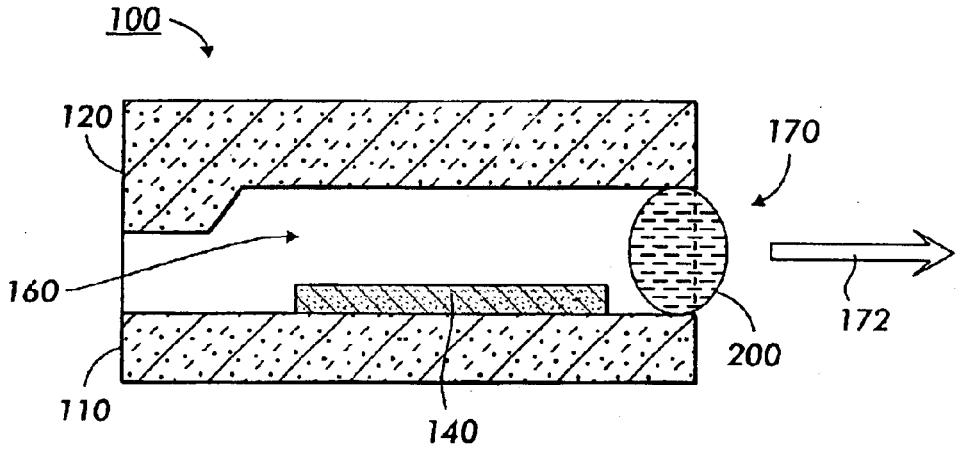
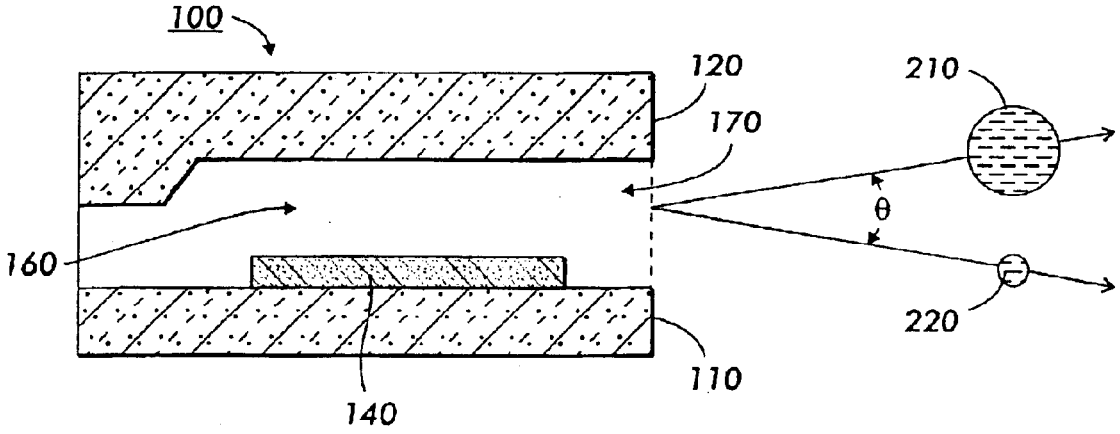
FIG. 2 (RELATED ART)

SYSTEMS AND METHODS FOR VARYING FLUID PATH GEOMETRY FOR FLUID EJECTION SYSTEM

BACKGROUND OF THE INVENTION

1. Field of Invention

This invention relates generally to the mechanical and electrical structure of fluid drop ejectors.

2. Description of Related Art

Fluid ejection systems, such as inkjet printers, employ an array of electrically addressable ejectors that eject fluid onto a receiving medium, such as paper. In a thermal fluid ejection system, an electric current is applied to a resistive beater in the ejector head, vaporizing fluid in a fluid chamber. The rapid expansion of fluid vapor ejects a fluid drop through the fluid path and out the ejector opening. Alternatively, non-thermal fluid ejection systems rely on over-pressure due to mechanical compression caused by a piezoelectric element or thermo-mechanical pressure pulse to selectively eject a fluid drop from the ejector opening. Regardless of the apparatus for selectively ejecting fluid drop, both thermal and mechanical fluid ejectors share similar ejector geometries and ejected fluid characteristics.

In order to maximize throughput, fluid ejection systems eject fluid bi-directionally while traversing linear paths across the receiving medium. As a result, fluid is ejected during the full range of motion of the fluid ejection system.

Typically, in most fluid ejection systems, when a main drop is ejected, one or more smaller satellite drops are ejected at a deviated trajectory from that of the main drop. That is, the volume of ejected fluid breaks into a main drop and one or more smaller satellite drops. The deviation between the trajectories of the main and satellite drops generally remains constant for a given ejector geometry as the fluid ejection system moves. However, the perceived effect varies as the direction of motion of the fluid ejection system across the receiving medium changes. This produces a series of repeating alternating patterns aligned in the plane of motion of the fluid ejection system across the receiving medium. This phenomenon is known as banding. This effect is exacerbated when overall ejected fluid densities in a given swath are high, such as in image recording, as opposed to text recording, where overall ejected fluid densities are relatively low.

Various techniques have been proposed to eliminate the banding effect. In one technique, multiple passes are printed for each swath to average out the effect, so that each line contains both forward direction drop separation distances and reverse direction drop separation distances. However, this approach negatively impacts throughput and fluid consumption. In another technique, fluid is ejected only in that direction of motion of the fluid ejection system that minimizes the drop separation distance. Ejecting fluid in a single direction effectively eliminates the banding defect, but negatively impacts throughput. A third technique focuses on minimizing the forward direction and reverse direction drop separation distances by reducing the angle of separation as much as possible, and ideally to zero. This is accomplished by tightly controlling ejector head geometry, ejector head motion, fluid drop velocity, and other variables. However, this approach is susceptible to random variations in manufacturing tolerances and becomes more difficult as ejection speeds increase, as resolution increases or drop size is reduced.

SUMMARY OF THE INVENTION

The banding defect could be eliminated, even with a non-zero angle of separation, if the distance of separation between the main drop and satellite drop could be made to vary in the forward and reverse directions in such a way as to exactly compensate for the motion of the print head. However, with a fixed print head geometry, the angle of separation cannot be altered.

The inventors of this invention have determined that asymmetrical structures in the nozzle region tend to increase the angle of separation between the main drop and satellite drop.

Movable actuators in the ink path of an ink jet print head are known. They are typically used as flow control valves to selectively open and close the nozzle of the print head. U.S. Pat. Nos. 5,897,789 and 5,790,156 disclose such actuators. The 789 patent discloses minute active valve members operable to control ink flow within an inkjet printhead. In one embodiment, the valve assembly is incorporated in an ink channel that delivers ink to the firing chambers of the printhead. The 156 patent discloses an actuator-driven ink jet device that uses a piezoelectric material bonded to a thin film diaphragm. When a voltage is applied to the actuator, the actuator attempts to change its planar dimensions, causing the actuator to deform about its fixed end. This displaces ink in the chamber, causing ink to flow both through an inlet from the ink supply to the ink chamber and through an outlet and passageway to a nozzle.

This invention provides systems and methods that vary an internal geometry of the fluid path of a fluid ejector.

This invention separately provides systems and methods that vary relative ejection trajectories of satellite and main drops ejected by a fluid ejection system.

This invention further provides systems and methods that vary the relative trajectories to reduce differences in drop separation distances between the satellite and main drops.

This invention further provides systems and methods that vary the relative ejection trajectories to obtain substantially constant drop separation distances between the satellite and main drops.

This invention further provides systems and methods that vary the relative ejection trajectories of the main and satellite drops based on a direction of motion of an ejector head that ejects the fluid drops.

This invention further provides systems and methods that vary the internal geometry of an ejector system to control differences in drop separation distances between the main and satellite drops.

This invention further provides systems and methods that vary the internal geometry of an ejector system to obtain a substantially constant drop separation distances between the main and satellite drops.

This invention further provides systems and methods that vary the internal geometry of an ejector system based on a direction of motion of an ejector head that ejects the fluid drops.

This invention further provides systems and methods that vary the internal geometry of an ejector system based on a direction of motion and a velocity of an ejector head that ejects the fluid drops.

This invention separately provides systems and methods that vary the internal geometry of an ejector system to controllably vary the relative trajectories of the main and satellite drops.

This invention separately provides systems and methods that vary the internal geometry of an ejector system by controllably actuating a mechanical actuator located within the fluid path.

This invention further provides systems and methods that vary the internal geometry of an ejector system by controllably energizing a bimetallic element.

This invention further provides systems and methods that vary the internal geometry of an ejector system by controllably energizing a piezoelectric elements or a microelectromechanical system.

In various exemplary embodiments, a controllable actuator is placed into the fluid path of each fluid ejector in a fluid ejector head. The controllable actuator is controllably actuated or energized to cause the actuator to alter the internal geometry of the fluid path. In various exemplary embodiments, the degree to which the internal geometry is altered is controllable based on the degree to which the actuator is actuated or energized.

By altering the internal geometry of the fluid path, the angle of separation, and thus the drop separation distance, changes. In various exemplary embodiments, the actuators are operated to reduce, and ideally hold constant, the drop-separation distance as the fluid ejector head moves in forward and reverse directions across the receiving medium. In various exemplary embodiments, in a direction of motion that tends to increase the drop separation distances, the actuators are operated to minimize the angle of separation. In contrast, in a direction of motion that tends to reduce the drop separation distance, the actuator is operated to increase the angle of separation such that the drop separation distance in that direction becomes closer to the drop separation distance in the other direction, and ideally is the same.

In various exemplary embodiments, the actuators are formed using bimetallic structures. When such bimetallic actuators are not actuated or energized, they assume a rest position, which, in various exemplary embodiments, is along a surface of the fluid path. When energized, such bimetallic elements bend away from the rest position due to differing coefficients of thermal expansion. In various exemplary embodiments, the energized bimetallic elements bend into the fluid path to alter the flow of the fluid as it is ejected from the ejector.

In various other exemplary embodiments, the actuators are formed by piezoelectric elements or microelectromechanical systems (MEMS). When such piezoelectric or MEMS are not energized, these devices assume a rest position. In various exemplary embodiments, the rest position is substantially outside of the flow of fluid through the ejector. When energized, such piezoelectric elements or MEMS deform to extend into the fluid passage, to alter the fluid flow of the fluid as it is ejected from the ejector.

These and other features and advantages of this invention are described in, or are apparent from, the following detailed description of various exemplary embodiments of the systems and methods according to this invention.

BRIEF DESCRIPTION OF THE DRAWINGS

Various exemplary embodiments of the systems and methods of this invention will be described in detail, with reference to the following figures, wherein:

FIG. 1 illustrates the fluid path of a conventional fluid ejector;

FIG. 2 illustrates separation angle between the main and satellite fluid drops when fluid is ejected from the fluid ejector shown in FIG. 1;

DETAILED DESCRIPTION OF EXEMPLARY EMBODIMENTS

Figure 3:
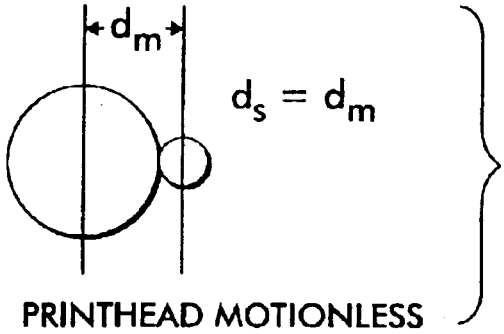
FIG. 3 (RELATED ART)
FIG. 3 illustrates the effect of the angle of separation on the separation distance between the main and satellite fluid drops when the fluid ejector is motionless.

The following detailed description of various exemplary embodiments of fluid ejection systems according to this invention may refer to one specific type of fluid ejection system, an ink jet printer, for sake of clarity and familiarity. However, it should be appreciated that the principles of this invention, as outlined and/or discussed below, can be equally applied to any known or later-developed fluid ejection systems, beyond the ink jet printer specifically discussed herein.

FIG. 1 illustrates the fluid path of a conventional thermal fluid ejector head. As shown in FIG. 1, an ejector head structure 100 includes a channel plate 110, a thermal plate 120, an ejector chamber 160, and an addressable heater element 140. A fluid drop 200 is formed in the ejector chamber 160 and is ejected through the nozzle opening 170. When current is applied to the addressable heating element 140, the temperature of the fluid in the chamber 160 rises rapidly. As a result, the fluid vaporizes, creating an overpressure in the ejector chamber 160. As a result, the fluid drop 200 is ejected through the ejector nozzle 170 in the direction indicated by the arrow 172.

FIG. 2 illustrates the angle of separation $\theta$ when the drop 200 is ejected from the ejector 100. As shown in FIG. 2, the fluid drop 200 separates into a main fluid drop 210 and at least one satellite fluid drop 220. The angle of separation θ0 generally remains constant whether the fluid ejector head 100 is motionless or moving in forward or reverse directions. The satellite drop 220 departs at a given angle of separation θ based on the size and shape of the nozzle 170. Also, the velocity and/or viscosity of the ejected fluid can affect the separation angle θ.

However, because the satellite drop 220 is ejected at a lower velocity than the main drop 210, is ejected at a time after the main drop 210, or both, the velocity and/or direction of the fluid ejector head motion will dictate the magnitude of the separation distance between the main drop 210 and the satellite drop 220 that is visible on a receiving medium. One direction of motion increases the amount of separation. In contrast, the other direction of motion reduces the amount of separation by carrying the satellite drop 220 in a direction of convergence with the main drop 210. This causes the amount of separation to be consistently smaller in one direction of fluid ejector motion than in the other direction of fluid ejector motion. These differing separation distances are visible on a receiving medium.

Figure 4:
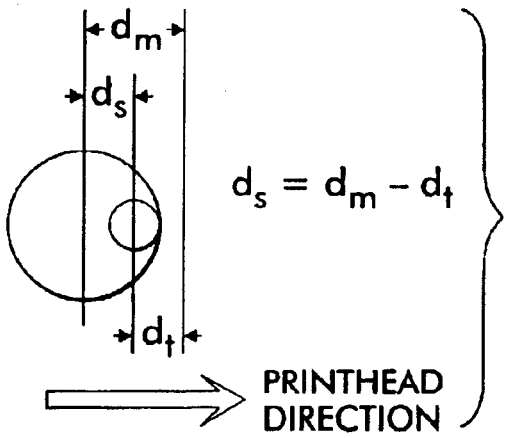
FIG. 4 (RELATED ART)
FIG. 4 illustrates the effect of the angle of separation on the separation distance between the main and satellite fluid drops when the fluid ejector moves in a direction that is toward the side of the satellite drop relative to the main drop.
Figure 5:
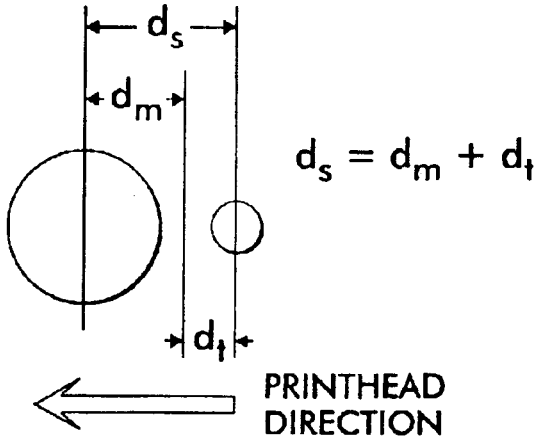
FIG. 5 (RELATED ART)
FIG. 5 illustrates the effect of the angle of separation on the separation distance between the main and satellite drops when the fluid ejector moves in a direction that is away from the side of the satellite drop relative to the main drop.

FIGS. 3, 4 and 5 illustrate the separation distances between the main drop and satellite drop under various conditions. For example, FIG. 3 illustrates the separation distance between the main and satellite fluid drops when the fluid ejector head is motionless. As shown in FIG. 3, the main drop 210 and satellite drop 220 are separated by a distance on the receiving medium as dictated by the angle θ and the distance from the nozzle to the receiving medium. The separation distance $d_s$ is equal to the motionless or natural separation distance $d_m$. However, in practical applications, the actual separation distance $d_s$ is rarely equal to the motionless separation distance $d_m$ because the fluid ejectors are typically in motion across the receiving medium when ejecting fluid.

When the fluid ejector head 100 moves in a first direction of motion, as indicated by the arrow in FIG. 4, that is toward the side on which the satellite drop 220 is ejected relative to the main drop 210, the separation distance $d_s$ between the main drop 210 and the satellite drop 220 is reduced. Therefore the distance $d_t$ that the satellite drop 210 moves, due to the movement of the fluid ejector head 100, in the time elapsed between contact of main drop 210 on the receiving medium and contact of the satellite drop 220 on the receiving medium reduces the separation distance $d_s$, so that $d_s=d_m-d_t$.

However, when the fluid ejector head moves in a second direction, as indicated by the arrow in FIG. 5, that is away from the side on which the satellite drop 220 is ejected relative to the main drop 210, the distance $d_t$ that the satellite drop 210 moves, due to the movement of the fluid ejector head 100, adds to the motionless separation distance $d_m$ between the main drop 210 and the satellite drop 220 so that the separation distance $d_s$ increases by $d_t$, that is, $d_s=d_m+d_t$. Therefore, as the fluid ejection head 100 ejects fluid during the first-direction swaths, the separation distance $d_s$ between the main drop 210 and the satellite drop 220 will be at a minimum.

In contrast, as shown in FIG. 5, when the fluid ejection head 100 ejects fluid during second-direction swaths, the separation distance $d_s$ between the main drop 210 and the satellite drop 220 will be at a maximum. The difference in the fluid drop separation distance between adjacent swaths generated by ejecting fluid in opposite directions of ejector motion produces a clearly visible and objectionable banding effect.

Figure 6:
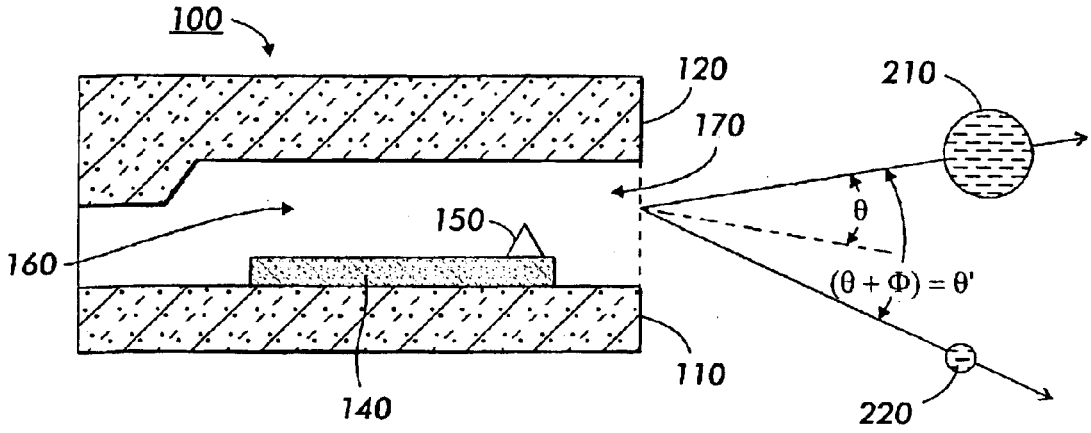
FIG. 6 illustrates the separation angle between the main and satellite fluid drops when drops are ejected with a bump in the fluid ejector nozzle that changes the nozzle geometry.

FIG. 6 illustrates the fluid ejection system 100 of FIG. 2 including the added feature of a generic bump 150, which is located in the ejector nozzle 170. The inventor of this invention has discovered that placing an asymmetry, such as a bump, in or near the nozzle 170, will increase the separation angle θ between the main fluid drop 210 and the satellite fluid drop 220. The amount of separation will be function of the shape and/or the dimensions of the bump. As illustrated in FIG. 6, the generic bump 150 causes the separation angle to increase by an incremental separation angle ϕ to θ', that is, $\theta'=\theta+\phi$.

However, the bump 150 will increase the angle of separation θ and the separation distance $d_s$ between the main fluid drop 210 and the satellite fluid drop 220 proportionately in both directions. Therefore, the overall separation will be increased but the difference between the separation distance in both first and second directions of motion will be unchanged.

If the angle of separation θ could he increased only in the direction of motion at which the separation distance $d_s$ is at a relative minimum, then the difference between the separation distance in the two directions of ejection head motion could itself be minimized, and, ideally, reduced to zero. Therefore, while the separation distance $d_s$ would always be at a relative maximum, the separation distance $d_s$ would be the same in both directions of motion.

In various exemplary embodiments according to this invention, by placing a movable actuator into the fluid ejection path, the angle of separation θ can be selectively increased when the ejector head travels in the direction of motion which tends to minimize the separation distance between the main fluid drop 210, and the satellite fluid drop 220.

The angle of separation θ can be returned to its base value when the fluid ejector head 100 travels in the direction of motion which tends to increase the separation distance between the main fluid drop 210 and the satellite fluid drop 220. The actuator can be selectively engaged to increase the nozzle asymmetry so that the separation distance $d_s$ is maintained nearly constant, regardless of the direction of motion of the fluid ejector head 100, thus reducing and, ideally, eliminating the visible banding effect.

In various exemplary embodiments, the movable actuator is placed behind the nozzle opening 170 to increase the angle of separation θ between the main fluid drop 210 and the satellite fluid drop 220. As discussed above with respect to FIG. 6, experimentation has shown that an asymmetry in the nozzle structure 170 will tend to increase the separation distance $d_s$ between the main drop 210 and the satellite drop 220. In various exemplary embodiments, by using a movable actuator, which can be selectively engaged and whose degree of actuation can be precisely controlled, it becomes possible to precisely and incrementally control the nozzle asymmetry.

Figure 7:
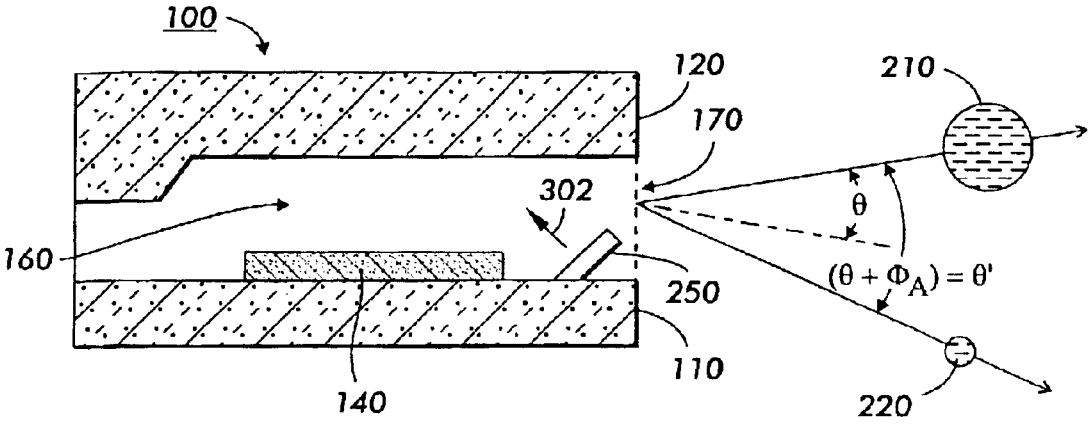
FIG. 7 illustrates one exemplary embodiment of an actuator located in the fluid path of a fluid ejector according to this invention.

FIG. 7 illustrates an exemplary embodiment of the fluid ejection system according to this invention. A fluid ejector head 100 includes the channel plate 110 and the thermal plate 120, which are sandwiched together to form the chamber 160 and the nozzle 170. In various exemplary embodiments of this invention, each nozzle structure includes the electrically addressable resistive heating element 140 disposed on the thermal plate 120. Current is applied to the heating element 140, causing the fluid to rapidly increase in temperature and vaporize. The overpressure in the fluid ejection chamber 160 causes the main and satellite fluid drops 210 and 220 to be ejected from the ejector nozzle 170.

Alternatively, in various exemplary embodiments, a piezoelectric element (not shown) may be used in place of the heating element 140 to force a fluid droplet 200 out of the nozzle 170. The chamber 160 and the nozzle 170 terminate at a nozzle opening. When a main fluid droplet 210 is ejected from the nozzle 170 at a time $t_0$, a satellite fluid droplet 220 is subsequently ejected at a later time and/or at a lesser velocity, and at a separation angle θ from the main droplet 210 with respect to the nozzle 170.

It should be appreciated that, in various exemplary embodiments, when the actuator 300, shown in FIG. 7, is in the relaxed position, its presence in the ejector nozzle 170 may increase the separation angle θ at least marginally over the case of no actuator. That is, given the small scale of the ejector nozzle 170 and the fluid drops 210 and 220, it is likely that any actuator will have at least a minimal effect on the separation angle θ.

When an electric current is applied to the actuator 300, the current causes the actuator 300 to bend upwards in the direction indicated by the arrow 302 in FIG. 7, effectively altering the geometry of the fluid ejector nozzle 170. This alteration causes the separation angle θ to increase to an angle of θ+ϕ, increasing the net separation distance $d_s$ between the main drop 210 and the satellite drop 220 that is visible on the receiving medium. Therefore, by applying a specific amount of current, the actuator 300 can be used to selectively increase the angle of separation θ between main fluid drop 210 and the satellite fluid drop 220. Furthermore, the magnitude of the increase in the separation angle θ and/or the increase in the separation distance $d_s$ can be controlled by selecting the material, the dimensions, and/or the like of the actuator 300 and/or the amount of current or power applied to the actuator 300.

As discussed above, in various exemplary embodiments, when the ejector head 100 moves in a first scan direction, the separation distance $d_s$ between the main fluid drop 210 and the satellite fluid drop 220 is at a maximum. During operation along this first scan direction, the actuator 300 is not engaged. Because of the direction of motion of the ejector head 100, the separation distance $d_s$ is at a maximum without the assistance of the actuator 300. However, when the fluid ejector head 100 moves in the second scan direction, the separation distance $d_s$ is at a relative minimum. At this time, a control signal is applied to the actuator 300, to activate the actuator 300. As a result, the actuator 300 bends upward, altering the geometry of the channel 160 and increasing the drop angle of separation θ. As a result, the separation distance $d_s$ increases. If the control signal is appropriately selected, the separator distance $d_s$ experienced during the first scan direction is equal to the separation distance $d_s$ experienced during the second scan direction. The actuator 300 remains engaged or activated until the ejector head 100 again reverses direction. Therefore, while the separation distance $d_s$ will always be at a maximum, the separation distance $d_s$ will be consistent in both first and second directions, reducing or, ideally, eliminating, the banding effect.

In various exemplary embodiments, the variable ejector geometry is obtained by using a bimetallic flap-like actuator 300 located upstream of the ejector nozzle opening and attached at one end to the thermal plate 120. It should be appreciated that, in general, the bimetallic flap offers the largest amount of motion with the least power output and lowest fabrication costs. However, it should be appreciated that the actuator 300 is not be limited to a particular material construction. Rather, various materials may be substituted for those disclosed herein without departing from the spirit or scope of this invention. When current is selectively applied to a small integral heater in the bimetallic actuator 300, differential thermal expansion of the bimetallic material will cause the bimetallic flap-like actuator 300 to bend upwards. When current is no longer applied to the actuator 300, as the actuator 300 cools (by losing heat to the fluid) the bimetallic flap will return to its at-rest position. The effectiveness of this bimetallic flap-like actuator 300 is due to multiple layers of materials having different coefficients of thermal expansion.

In various exemplary embodiments, the actuator 300 is implemented as a bimetal flap having dimensions of approximately 20×40 μm. These dimensions approximate the dimensions of the ejector nozzle area, and are given for illustrative purposes only. The actual dimensions will be dictated by the dimensions and geometry of the nozzle area and/or the degree to which the minimum separation distance $d_s$ needs to be increased. Experimental testing has shown that a 200° C. temperature rise in a bimetal actuator of similar dimensions will produce a deflection of approximately 5.25 μm. A change in actuator geometry of this magnitude has been experimentally shown to produce large variations in the separation distance $d_s$ between the main drop 210 and the satellite drop 220. It should be appreciated that the deflection of the actuator can be increased by increasing the length of the beam, by using higher actuation temperatures and/or by using different materials with larger differences in their coefficients of thermal expansion. Using of materials, such as polysilicon and aluminum, to form the bimetallic element reduces costs due to materials and manufacturing complexity because these materials are already used in manufacturing fluid ejection systems.

In various exemplary embodiments, one or both of the thermally expansive materials must be sufficiently electrically conductive to act as an electrically driven resistive heater to drive the actuator. The larger the differential of the thermal expansion coefficients between the two expansive layers, the more efficient the actuator 300 will be in terms of energy consumption.

In various exemplary embodiments, the actuator 300 is formed by encapsulating three layers having low, high and low coefficient of thermal expansion materials, respectively. Current is applied to the highly expansive material, which acts as a heater. When current is applied to this material, this material becomes hot and deflects upwards, while the other end remains fixed to the ejector surface. As in the other embodiments, the actuator will return to its rest position when the current is no longer applied.

In various exemplary embodiments, the actuator 300 may be formed using a single encapsulated layer of a material having a high coefficient of thermal expansion. The single layer embodiment can be manufactured directly on the silicon substrate or bonded after manufacturing. The single layer material is electrically connected to the ejector head so that when a current is applied to the free end of the material, the free end is forced to bend upwards due to the heat generated in the material.

Figure 8:
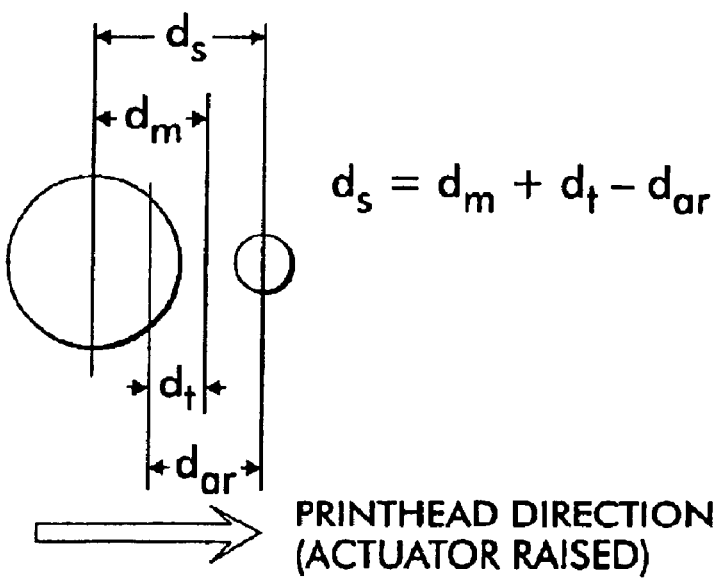
FIG. 8 illustrates the effect on the angle of separation when the actuator is in a first position, and thus the drop separation distance when the ejector head moves in a direction that is toward the side of the satellite drop relative to the main drop.

FIG. 8 illustrates that, when the ejector head 100 is moving in a first direction with the actuator 300 raised, the separation distance $d_s$ increases to $d_m+d_{ar}-d_t$, where $d_m$ is the motionless separation distance when the fluid ejector head 100 is motionless, $d_t$ indicates the amount of separation distance caused by motion of the fluid ejector head 100 during operation and $d_{ar}$ indicates the increased separation distance caused by the increased angle of separation θ due to the raised actuator 300. Therefore the separation distance $d_s$, which was previously at a minimum when the fluid ejector head was moving in a first direction, has now been increased to be equivalent to the relative maximum.

Figure 9:
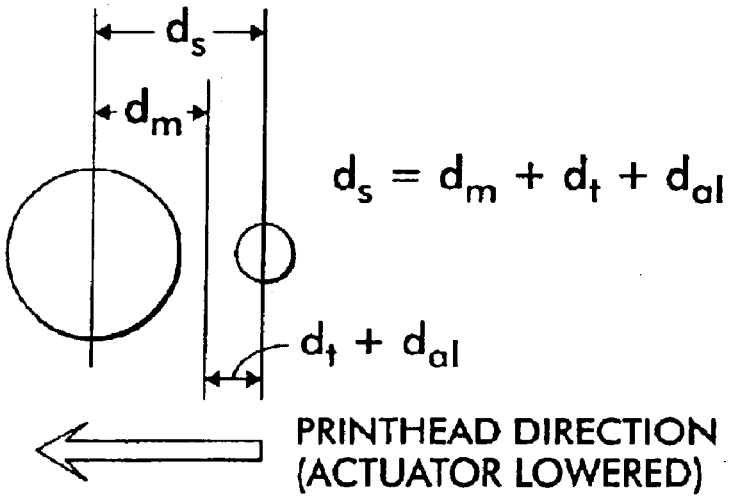
FIG. 9 illustrates the effect on the angle of separation when the actuator is in a second position, and thus the drop separation distance when the ejector head moves in a direction that is away from the side of the satellite drop relative to the main drop.

Conversely, as illustrated in FIG. 9, when the ejector head 100 moves in a second direction, with the actuator 300 lowered, the separation distance $d_s$ is equal to $d_m+d_t+d_{ar}$. At this point, separation distance $d_s$ between the main fluid drop 210 and the satellite fluid drop 220 is also at a maximum. By raising the actuator 300 in the direction indicated by the arrow 302 in FIG. 7 while the fluid ejector head 100 is moving in the first, or separation-minimizing, direction, the separation angle θ can be increased such that the separation distance $d_a$ caused by the actuator 300, can be made to offset the difference in the separation distance $d_s$ between the first and second directions. In various exemplary embodiments, the actuator 300 will be raised such that separation distance $d_{ar}$ due to the actuator 300 is equal to twice the nominal motion-related separation distance $d_t$, i.e., $d_{ar}=2d_t$. This should exactly offset the tightening effect caused by the motion of the ejector head in the first direction, such that the separation distance $d_s$ would be maintained at a constant value.

Referring again to FIG. 7, current is applied to the heating element in the actuator 300, causing the actuator 300 to bend upwards. Current is continually applied until the ejector 100 reverses direction. FIG. 7 illustrates that separation distance $d_s$ when the actuator is raised and the ejector head 100 is moving in the first direction, is equal to $d_m-d_t+d_a$ or simply $d_m+d_t$ when $d_a$ is equal to $2d_t$.

FIG. 8 illustrates that when the actuator 300 is lowered, when the ejector 100 changes direction to move on the rewind, or distance maximizing, direction, the separation distance $d_s$ is simply equal to $d_m+d_t+d_a$ where $d_a$ is equal to 0.

Therefore, as the ejector head 100 ejects swaths in the first and second directions, current is selectively applied to and withdrawn from the actuator 300 to selectively raise and lower the actuator 300, respectively. In response, the angle of separation θ is varied to maintain a motion-independent constant separation distance $d_s$, reducing and, ideally, eliminating, the undesirable banding effect.

Figure 10:
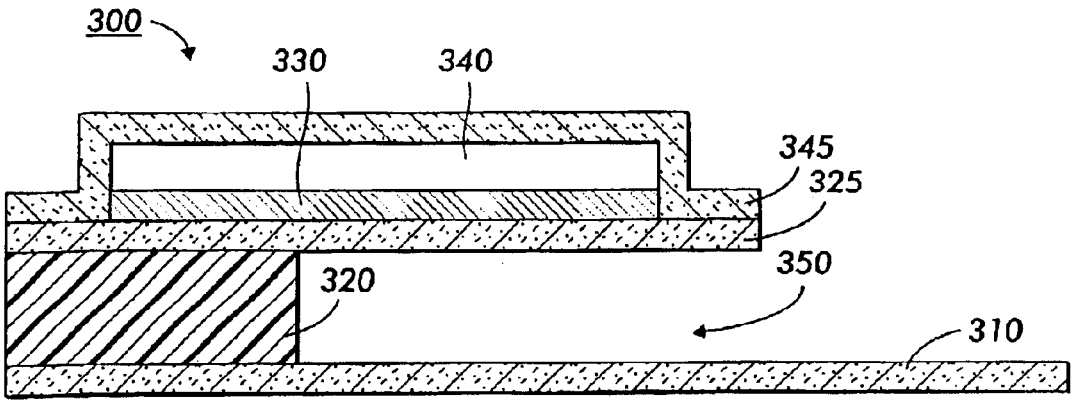
FIG. 10 illustrates in greater detail a first exemplary embodiment of the actuator of FIG. 7, where the actuator includes a bimetallic structure.

FIG. 10 illustrates one embodiment of a method for forming the actuator 300 according to this invention. As shown in FIG. 10, a thick field oxide layer 320 is deposited on or over a substrate 310. Next, a silicon nitride layer 325 is deposited on or over the oxide layer 320 in a pattern approximating the shape and dimensions of the actuator 300. In various exemplary embodiments, the nitride layer 325 may extend beyond the oxide layer 320. Next, a material 330 having a high coefficient of thermal expansion is deposited upon a portion of the silicon nitride layer 325. In various exemplary embodiments, the material 330 terminates before the distal end of the silicon nitride layer 325. Then, a material 340 having a lower coefficient of the thermal expansion relative to the material 330 is deposited on or over the material 330. In various exemplary embodiments, the material 340 is deposited in a nearly identical pattern to that used for the material 330. Then, an encapsulating layer, 354 such as a layer of plasma silicon nitride, is deposited on or over the stack of layers 325,330 and 340 and patterned as illustrated in FIG. 10. Finally, a solvent, such as hydrofluoric acid is applied to the field oxide layer 320 to undercut the actuator 300, leaving an air gap 350 and releasing the actuator 300 from the substrate 310. Thus, when current or heat is applied to the material 330 with a high coefficient of thermal expansion, the actuator 300 will bend upwards at the free end.

In various other exemplary embodiments, the actuator is a piezoelectric element that extends into the channel 160 when a voltage is applied between two electrodes surrounding a piezoelectric film. When a voltage is applied the piezoelectric film, and any encapsulating layers, these layers deform, causing an asymmetry in the ejector nozzle opening. The actuator returns to the non-deformed position when the potential between the two electrodes is removed. The piezoelectric element may be manufactured separately from the ejector head and bonded to a surface of the thermal plate 120 or the channel plate 110, or manufactured directly on the silicon substrate making up the lower or upper plate.

Figure 11:
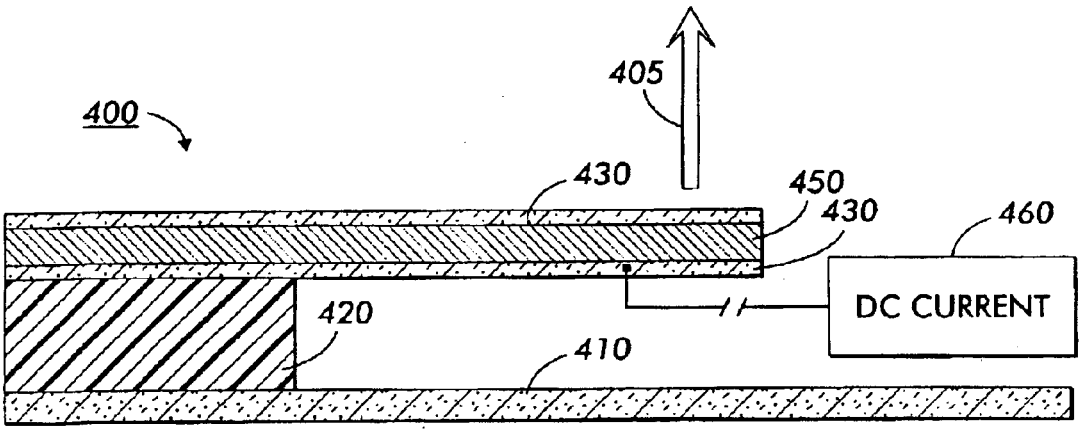
FIG. 11 illustrates in greater detail a second exemplary embodiment of the actuator of FIG. 6, where the actuator includes a piezoelectric element.

FIG. 11 illustrates one exemplary embodiment of a piezoelectric actuator device usable in various exemplary embodiments as an actuator in this invention. As shown in FIG. 11, the piezoelectric actuator device 400 is formed by depositing a thick field oxide layer 420 on or over a substrate 410. Next, a metallic layer 430 is deposited on or over the field oxide layer 420. Then, a piezoelectric ceramic layer 440, such as lead zirconium titanate, is deposited on or over the metallic layer 430 and a second metallic layer is deposited on or over the piezoelectric layer 440. A solvent is then sparsely applied to the field oxide layer 420 to undercut the field oxide layer 420 and to free one end of the actuator 400. A drive circuit is connected to the free end of the actuator 400 to provide electrical current to the actuator 400. When current is applied to the actuator 400, the actuator 400 bends in the upward direction as indicated by arrow 405.

In various other exemplary embodiments, the actuator 300 can be a moveable element driven by electrostatic forces. In such an embodiment, a voltage is applied to an electrode, which creates a Coulomb force between the electrode and a conductive portion of the actuator, causing the actuator 300 to lift until the Coulomb force dissipates.

Figure 12:
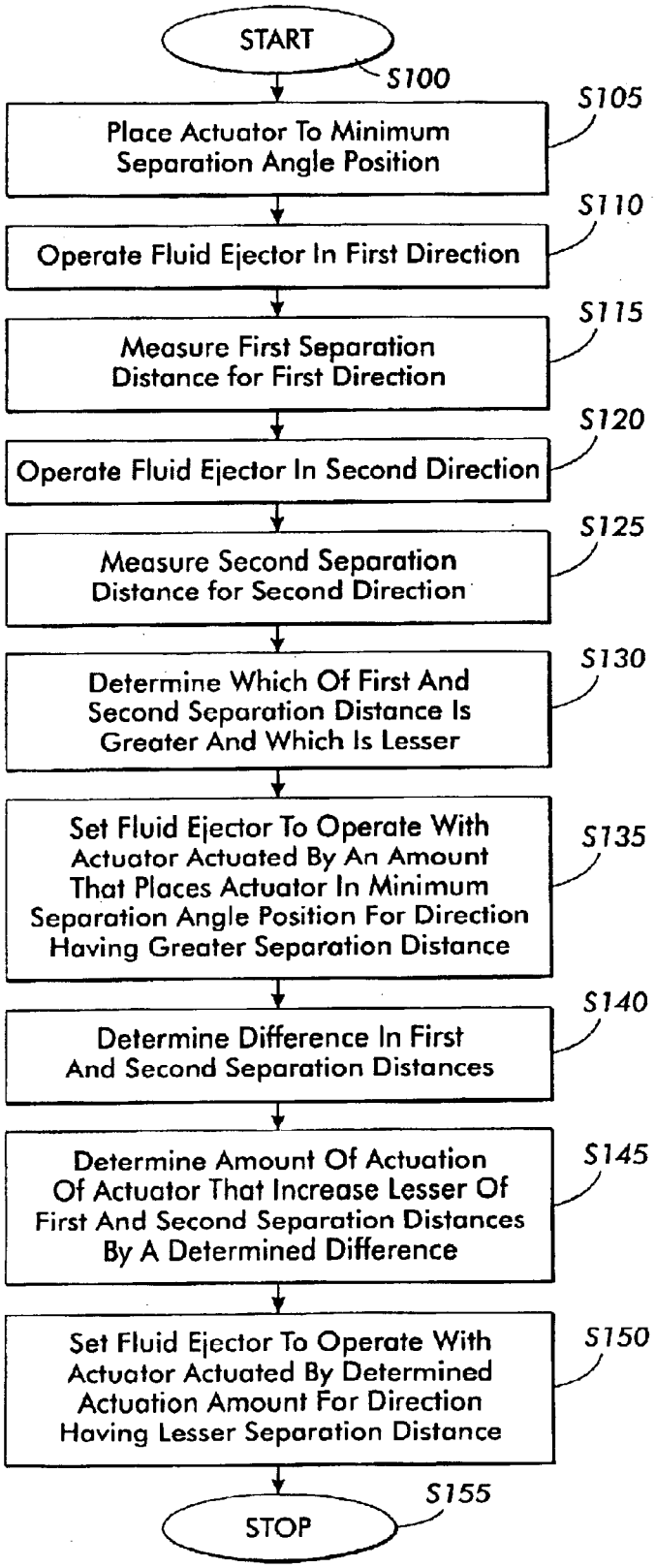
FIG. 12 is a flowchart outlining one exemplary embodiment of a method of initializing the fluid ejector and actuator shown in FIG. 7.

FIG. 12 is a flowchart outlining an exemplary embodiment of a method for calibrating a fluid ejection system with a moveable actuator according to this invention. The process starts at step S100, and continues to step S105, where the actuator is placed at the minimum separation angle position, such as the natural or relaxed position.

Then, in step S110, the fluid ejector is operated in a first direction. Next, in step S115, the actual first separation distance for the first direction is measured at least once as the fluid ejector travels and/or after the fluid ejector has traveled, in the first direction. Next, in step S120, the fluid ejector is operated in a second direction at least once. Operation then continues to step S125.

In step S125, the second separation distance for the second direction is measured at least once as the fluid ejector travels and/or after the fluid ejector has traveled, in the second direction. Next, in step S130, a determination is made regarding which of the first and second separation distances is greater and which is lesser. Then, in step S135, the fluid ejector is then set to operate with the actuator activated by an amount that places the actuator in the minimum separation angle position for the direction having the greater separation distance. Operation then continues to step S140.

In step S140, the difference between the first and second separation distances is determined. Then, in step S145, the amount of actuation of the actuator that increases the lesser of the first and second separation distances by a determined distance is determined. Next, in step S150, the fluid ejector is set to operate with the actuator activated by the determined actuation amount for the direction having lesser separation distance. Operation then continues to step S155, where operation of the method ends.

Figure 13:
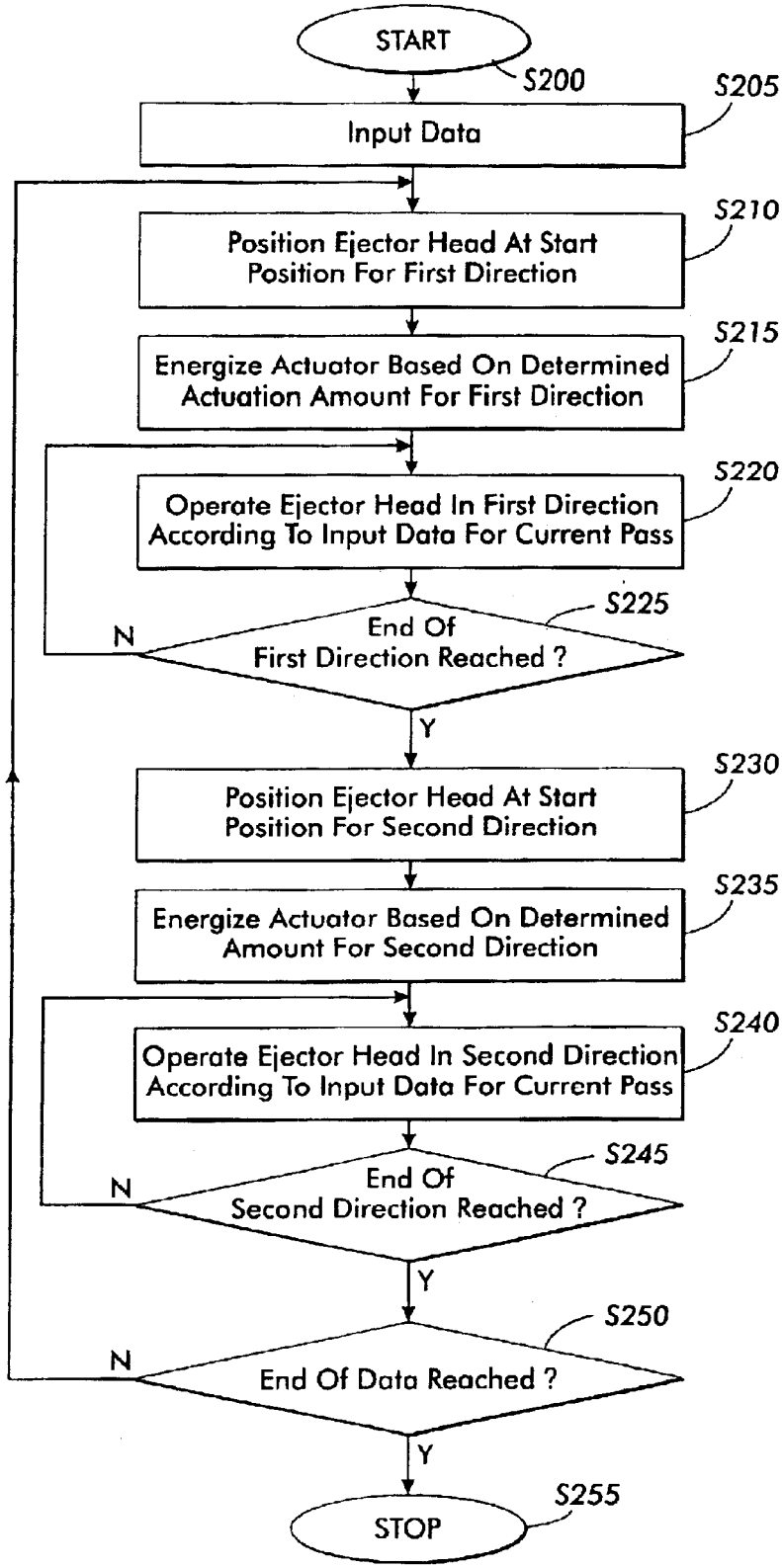
FIG. 13 is a flowchart outlining one exemplary embodiment of a method of operating the fluid ejector and actuator shown in FIG. 7.

FIG. 13 is a flowchart outlining an exemplary embodiment of a method of operating an exemplary fluid ejector system and actuator according to this invention. As shown in FIG. 13, operation of the method begins in step S200, and continues to step S205, where input data is received by the fluid ejector system. Then, in step S210, the ejector head is positioned at the start position for a first direction of motion. Next, in step S215, the actuator is energized based on the determined actuation amount for the first direction. Operation then continues to step S220.

In step S220, the ejector head is operated in a first direction according to input data for the current pass. Next, in step S225, a determination is made whether the end of the travel distance of the ejector in the first direction has been reached. If so, operation proceeds to step S230. Otherwise, operation returns to step S225. In step S230, the ejector head is positioned at a start position for a second direction. Then, in step S235, the actuator is energized based on the determined actuation amount for the second direction. Next, in step S240, the ejection head is operated in the second direction according to the input data for the current pass. Operation then continues to step S245.

In step S245, a determination is made whether the end of travel distance of the ejector in the second direction has been reached. If so, operation continues to step S250. Otherwise, operation returns to S240 for continued operation of the ejector head according to input data for the current pass along the second direction. In step S250, a determination is made whether the end of all data has been reached. If not, operation returns to step S210, so that the ejector may again eject fluid while traveling in the first direction. Otherwise, operation proceeds to step S255, where operation of the method ends.

Figure 14:
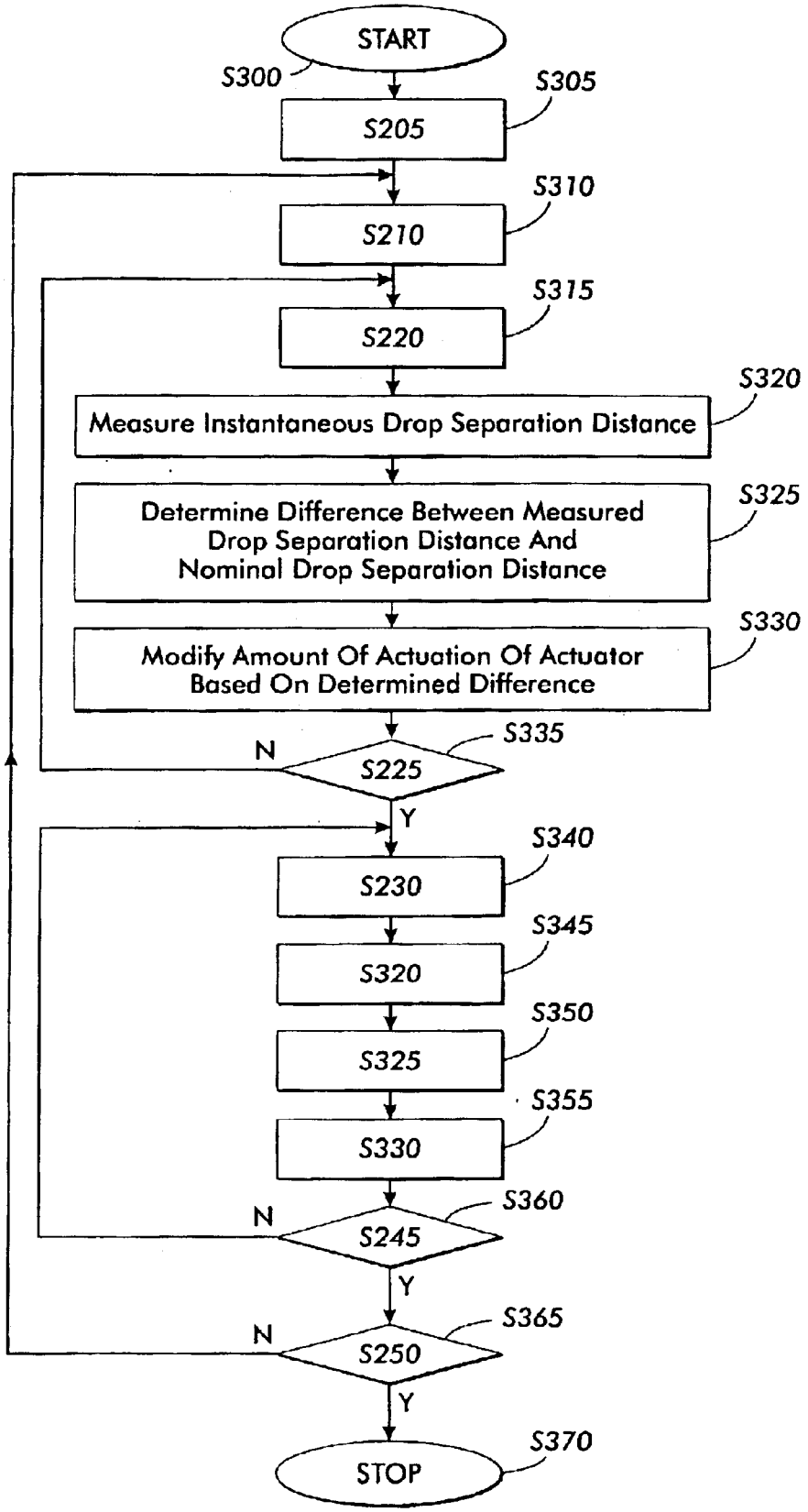
FIG. 14 is a flowchart outlining one exemplary embodiment of a method for operating the fluid ejector and actuator of FIG. 7 when the drop separation distance can be measured during operation.

FIG. 14 is a flowchart outlining an exemplary embodiment of a method for operating a fluid ejector according to this invention where the drop separation distance can be measured during operation of the fluid ejector. For example, the method outlined in FIG. 14 can be used to compensate for changes in separation distance between main drops and satellite drops due to changes in the fluid ejector head velocity. As shown in FIG. 14, operation of the method begins in step S300, and continues to step S305, where input data is received by the ejector head. Next, in step S310, the ejector head is positioned at the start position for a first direction. Then, in step S315, the ejector head is operated in the first direction according to the input data for a current pass. Operation then continues to step S320.

In step S320, the instantaneous drop separation distance is measured. Then, in step S325, the difference between the measured instantaneous drop separation distance and the nominal separation distance $d_s$ is determined. Next, in step S330, the amount of actuation of the actuators is modified based on the determined difference. Operation then continues to step S335.

In step S335, a determination is made whether the end of the travel distance of the ejector in the first direction has been reached. If not, operation returns to step S315. Otherwise, operation continues to step S340, where the ejector head is positioned at the start position for a second direction. Next, in step S345, the instantaneous drop separation distance is measured as the ejector travels in the second direction. Then, in step S350, the difference is determined between the measured instantaneous drop separation distance and the nominal drop separation distance $d_s$. Operation then continues to step S355.

In step S355, the amount of actuation of the actuator is modified based on the determined separation difference. Then, in step S360, another determination is made whether the end of travel distance of the ejector in the second direction has been reached. If not, operation returns to step S340 and continues recursively until completed. Otherwise, operation proceeds to step S365.

In step S365, where a determination is made whether the end of the data has been reached. If not, operation returns to step S310, where the ejector head is positioned for a first direction. Otherwise, operation continues to step S370, where operation of the method ends.

It should be appreciated that due to uncontrollable variations in nozzle and channel structures resulting from the manufacturing process the amount of actuation may vary for each ejector channel and nozzle. Therefore, the amount of separation distance between the main fluid drop and satellite fluid drop may vary as well as the direction that maximizes drop separation. Therefore, nozzle and channel specific, individual control of actuation may be necessary.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A variable geometry fluid ejection device, comprising:

an addressable fluid ejector apparatus usable to eject a fluid drop and defining a fluid ejection path;

at least one nozzle of the addressable fluid ejector apparatus located at an end of the fluid ejection path, the nozzle defining an opening through which the fluid drop is ejected onto a receiving medium;

an actuator, electrically connected to a power source and located in the fluid ejection path and behind the opening of the nozzle, wherein the actuator is raised and lowered to selectively alter a geometry of the fluid ejection path.

2. The device of claim 1, wherein the actuator is raised and lowered corresponding to alternating swaths of the fluid ejection device across the receiving medium.

3. The device of claim 1, wherein the actuator comprises one or more thermally conductive materials.

4. The device of claim 3, wherein the actuator comprises at least two layered materials, a first one of the materials having a higher coefficient of thermal expansion than that of a second one of the materials.

5. The device of claim 1, wherein the actuator is a piezoelectric device.

6. The device of claim 1, wherein the actuator is a micro-electromechanical device.

7. The device of claim 1, wherein:

the fluid ejection device travels in a first direction and a second direction; and the actuator is raised in only one of two directions of fluid ejection device motion.

8. The device of claim 7, wherein the actuator is raised to increase separation distance between a main fluid drop and a satellite fluid drop when the ejector device moves in one of the first and second directions.

9. The device of claim 8, wherein the actuator is selectively raised to increase the separation distance between the main fluid drop and the satellite fluid drop so that the separation distance in the first direction of ejector motion is approximately equal to the separation distance in the second direction of ejector motion.

10. A method of increasing separation distance between main and satellite fluid drops ejected from a bi-directional fluid ejection device onto a receiving medium, the method comprising:

supplying electrical current to an actuator located behind a nozzle opening of a fluid ejection path to cause the actuator to be raised before the bi-directional fluid ejection device ejects fluid.

11. The method of claim 10, wherein current is supplied to the actuator when the bi-directional fluid ejection device travels in a direction of motion that tends to increase the separation distance.

12. The method of claim 10, wherein the supply of electrical current to the actuator is eliminated when the bi-directional fluid ejection device moves in a direction of motion that tends to increase the separation distance.

13. The method of claim 10, wherein the separation distance is maintained relatively constant in both directions of motion by selectively supplying and removing electrical current to the actuator based on the direction of bi-directional fluid ejection device motion.

14. The method of claim 10, wherein the actuator comprises a bimetallic element comprised of at least two layers of a thermally conductive material.

15. The method of claim 10, wherein the actuator comprises a piezoelectric device.

16. The method of claim 10, wherein the actuator comprises a micro-electromechanical device.

17. The method of claim 10, wherein supplying electrical current comprises controlling an amount of actuation by the actuator by at least one of actuator materials, current amount supplied to the actuator and temperature increase of the actuator.

18. A fluid ejection system, comprising:

a fluid ejector head;

a fluid supply;

a fluid ejector having a fluid ejection path and terminating in a nozzle;

a controllable actuator, located in the fluid ejection path upstream of the nozzle, that is selectively engageable to selectively alter the geometry of the fluid ejection path.

19. The system of claim 18, wherein the actuator comprises at least one thermally expansive material.

20. The system of claim 18, wherein the actuator comprises a piezoelectric device.

21. The system of claim 18, wherein the actuator comprises a micro-electromechanical device.

22. The system of claim 18, wherein the system is a bi-directional system that ejects fluid in two directions of ejector head motion.

23. The system of claim 18, wherein the controllable actuator is selectively engageable based on a direction of the fluid ejector head across a receiving medium.

24. The system of claim 23, wherein the actuator is activated when the ejector head moves in a direction of motion which tends to increase a separation distance between a main fluid drop and a satellite fluid drop.

25. The system of claim 23, wherein the actuator is activated in one direction of ejector head motion to maintain a relatively constant separation distance through both directions of motion.

* * * * *